US009964319B2

(12) United States Patent
Cha et al.

(10) Patent No.: US 9,964,319 B2
(45) Date of Patent: May 8, 2018

(54) AIR CONDITIONER AND METHOD FOR CONTROLLING AN AIR CONDITIONER

(71) Applicant: LG ELECTRONICS INC., Seoul (KR)

(72) Inventors: Wooho Cha, Seoul (KR); Kwanho Yum, Seoul (KR); Jaeyoon Oh, Seoul (KR); Song Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 406 days.

(21) Appl. No.: 14/642,010

(22) Filed: Mar. 9, 2015

(65) Prior Publication Data

US 2015/0267933 A1 Sep. 24, 2015

(30) Foreign Application Priority Data

Mar. 24, 2014 (KR) ..... 10-2014-0034302

(51) Int. Cl.

| | |
|---|---|
| ***F25B 1/00*** | (2006.01) |
| ***F24F 5/00*** | (2006.01) |
| ***F24F 1/44*** | (2011.01) |

(52) U.S. Cl.

CPC ..... *F24F 5/001* (2013.01); *F24F 1/44* (2013.01); *F24F 11/30* (2018.01); *F24F 11/46* (2018.01); *F24F 2140/60* (2018.01)

(58) Field of Classification Search

CPC ..... F24F 1/44; F24F 11/00; F24F 11/0009; F24F 5/001; F24F 2011/047; F24F 2011/0075; F24F 11/06

See application file for complete search history.

(56) References Cited

U.S. PATENT DOCUMENTS

| | | | |
|---|---|---|---|
| 6,518,727 | B2 | 2/2003 | Oomura et al. |
| 2003/0061828 | A1 | 4/2003 | Blevins |

FOREIGN PATENT DOCUMENTS

| | | | |
|---|---|---|---|
| EP | 1 925 886 | A2 | 5/2008 |
| EP | 2 413 449 | A2 | 2/2012 |
| JP | H 6-74537 | A | 3/1994 |
| JP | 2005-291607 | | 10/2005 |
| JP | 2007-101050 | | 4/2007 |
| JP | 2010-121896 | | 6/2010 |

(Continued)

OTHER PUBLICATIONS

International Search Report dated Apr. 9, 2015.

(Continued)

*Primary Examiner* — Elizabeth Martin
(74) *Attorney, Agent, or Firm* — KED & Associates, LLP

(57) ABSTRACT

An air conditioner and a method for controlling an air conditioner are provided. The air conditioner may include at least one indoor device, an outdoor device connected to the indoor device, the outdoor device including a compressor that compresses refrigerant, an engine generating a power using combustion gas, a generator that generates electricity using the power, a battery that receives at least a portion of the electricity, a first supply line that supplies the electricity stored in the battery into the outdoor device, and a second supply line that supplies the electricity stored in the battery into the at least one indoor device. The battery is charged by the generator, or the electricity stored in the battery is discharged into the indoor device or the outdoor device according to operation performance of each of the indoor device and the outdoor device.

14 Claims, 5 Drawing Sheets

(56) References Cited

FOREIGN PATENT DOCUMENTS

| | | |
|---|---|---|
| JP | 2012-042176 | 3/2012 |
| JP | 2012-229900 | 11/2012 |
| KR | 10-2013-0094929 A | 8/2013 |

OTHER PUBLICATIONS

Korean Office Action dated May 20, 2015.
European Search Report issued in Application No. 14191643.7 dated Aug. 19, 2015.

AIR CONDITIONER AND METHOD FOR CONTROLLING AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0034302, filed in Korea on Mar. 24, 2014, which is hereby incorporated by reference in its entirety.

BACKGROUND

1. Field

An air conditioner and a method for controlling an air conditioner are disclosed herein.

2. Background

Air conditioners are apparatuses that cool/heat or purify air in an indoor space in order to provide a more comfortable indoor environment for a user. Air conditioners may be classified into split type air conditioners, in which indoor and outdoor units or devices are separated from each other, and integral type air conditioners, in which indoor and outdoor units are integrally coupled to each other as a single unit or device. Air conditioners may also be classified into single type air conditioners having a capacity capable of operating one indoor unit or device so as to be used in narrow spaces, middle and large sized air conditioners having a very large capacity so as to be used in companies or restaurants, and multi-type air conditioners having a capacity capable of sufficiently operating a plurality of indoor units according to the capacity thereof.

Such a split type air conditioner may include an indoor unit or device installed in an indoor space to supply hot wind or cold wind into a space to be air-conditioned, and an outdoor unit or device, in which compression and expansion are performed to perform a sufficient heat-exchanging operation in the indoor unit or device. The split type air conditioner may be classified into an electric heat pump (EHP) air conditioner and a gas heat pump (GHP) air conditioner according to power sources for operating a compressor. The EHP air conditioner uses electricity as a power source for the compressor, and the GHP air conditioner uses a fuel, such as an LNG or an LPG, as a power source for the compressor. The GHP air conditioner operates an engine through fuel combustion to provide an output of a compressor motor.

A prior art relating to the GHP air conditioner is disclosed in Korea Patent Application No. 10-2012-0016202, which is hereby incorporated by reference. In the EHP air conditioner according to the related art, supply current is adjusted to easily control the compressor. Thus, the EHP air conditioner is adequate for response to a partial load and has high energy efficiency. However, the EHP air conditioner may have a limitation in that frost may form on an outdoor heat exchanger when low-temperature heating is performed.

On the other hand, the GHP air conditioner may have an advantage in that waste heat of the engine is used to improve defrosting performance. However, the GHP may have low engine efficiency due to heat loss.

Also, in the GHP air conditioner, a generator may be provided to generate power using a power source of the engine. The generated electricity may be used to operate the air conditioner.

However, in the GHP air conditioner according to the related art, the generated electricity may be lacking or excessive, reducing operation efficiency.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
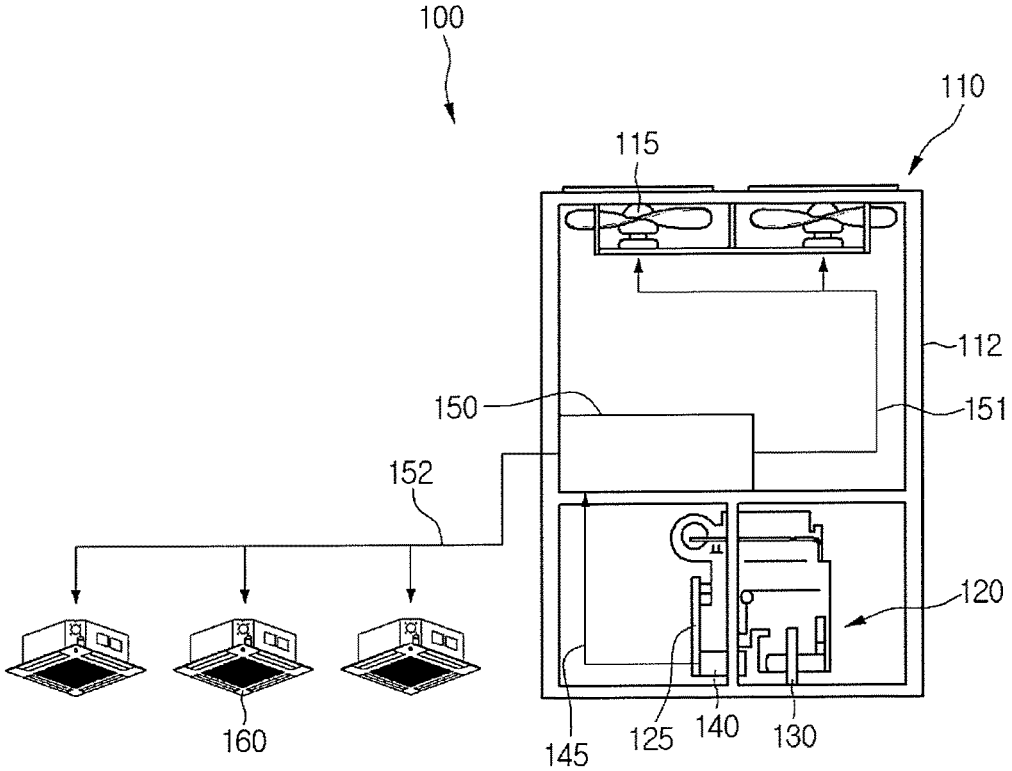
FIG. 1 is a schematic diagram of an air conditioner according to an embodiment.

FIG. 1 is a schematic diagram of an air conditioner according to an embodiment. Referring to FIG. 1, an air conditioner 100 according to an embodiment may include an outdoor unit or device 110 disposed in an outdoor space, and at least one indoor unit or device 160 connected to the outdoor device 110, disposed in an indoor space, and including an indoor heat exchanger.

The outdoor device 110 may be a gas heat pump (GHP) type outdoor device. The outdoor device 110 may include a plurality of components, for example, a compressor 130 and an outdoor heat exchanger within a case 112. A separate external power is not supplied into the outdoor device 110, and thus, power required for the air conditioner 100 may be supplied by operating a generator through an engine.

In detail, the outdoor device 110 may include an engine 120 that generates power using a combustion gas, and compressor 130 and a generator 140, which may operate using the power generated by the engine 120. The compressor 130 may compress a refrigerant circulating in a refrigeration cycle. The generator 140 may generate electricity required to operate the air conditioner 100. The refrigerant compressed in the compressor 130 may be circulated in the refrigeration cycle while being condensed, expanded, and evaporated.

The power generated by the generator 140 may be supplied to power components of the outdoor device 110, for example, one or more outdoor fan 115 that generates an air flow or a coolant pump (not shown) that allows a coolant for cooling the engine 120 to flow. The power generated by the generator 140 may be supplied to power components of the indoor device 160, for example, an indoor fan (not shown).

The outdoor device 110 may further include a power transmission 125 to transmit power generated by the engine 120 to the generator 140. For example, the power transmission 125 may include an engine pulley provided in the engine 120, a generator pulley provided in the generator 140 and spaced apart from the engine pulley, and a belt that connects the engine pulley to the generator pulley. When the engine 120 operates, the power of the engine 120 may be transmitted to the compressor 130 to compress the refrigerant and transmitted to the generator 140 through the power transmission 125 to generate power.

The outdoor device 110 may further include a battery 150 that stores the power generated by the generator 140, and a connection line 145 that extends from the generator 140 to the battery 150 to supply the power generated in the generator 140 to the battery 150. The battery 150 may store and use power required for the air conditioner 100 according to preset or predetermined conditions.

The air conditioner 100 may further include a first supply line 151 that supplies the power charged in the battery 150 to the power components of the outdoor device 110, for example, the outdoor fan 115, and a second supply line 152 that supplies the power changed in the battery 150 to the power components of the one or more indoor device 160, for example, one or more indoor fan.

Figure 2:
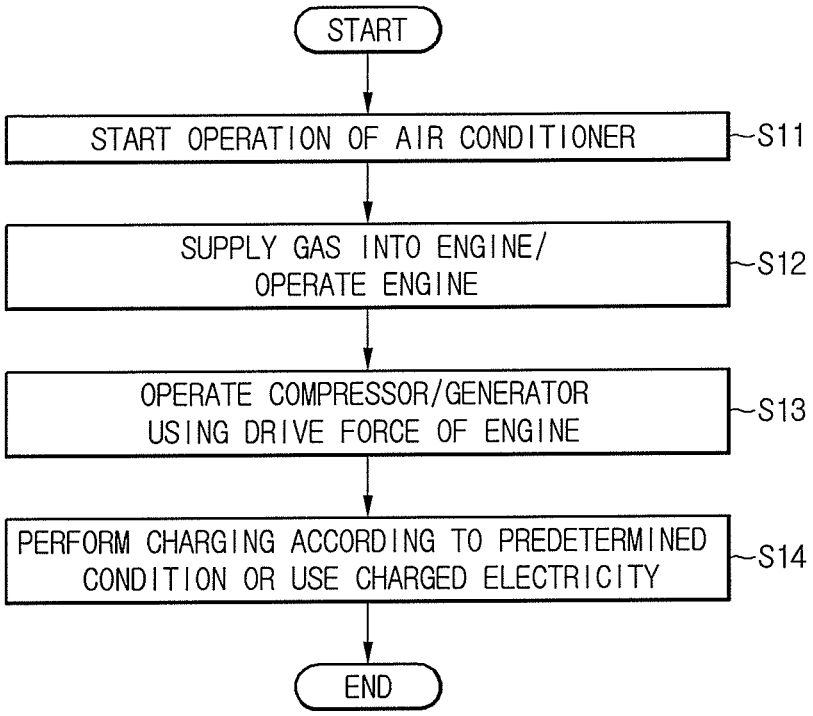
FIG. 2 is a flowchart of a method for controlling an air conditioner according to an embodiment.

FIG. 2 is a flowchart of a method for controlling an air conditioner according to an embodiment. Referring to FIG. 2, an operation method of the air conditioner 100 will be described hereinbelow.

When an operation of an air conditioner 100 starts, engine 120 provided in GHP type outdoor device 110 may operate. In detail, a gas fuel, such as LNG or LPG, may be supplied to the engine 120 to operate the engine, steps S11 and S12.

The engine 120 may operate to generate power. The generated power may be transmitted to compressor 130 and generator 140. The power transmitted to the compressor 130 may be used to compress a refrigerant suctioned into the compressor 130, and the power transmitted into the generator 140 may be used to generate power.

The power generated by the generator 140 may be supplied to power components of the air conditioner 100, for example, power components of the outdoor device 110 or indoor device(s) 160 to continuously maintain the operation of the air conditioner, step S13.

According to preset or predetermined condition(s), the battery 150 may be charged, or electricity charged in the battery 150 may be used, in step S14. For example, while the air conditioner 100 operates, power remaining after the power generated by the generator 140 is supplied to the power components of the air conditioner 100 may be stored in the battery 150. Also, if power consumption in the air conditioner 100 is larger than the power generated by the generator 140, the power stored in the battery 150 may be used.

More particularly, if operation performance (or an operation load) of the air conditioner 100 is greater than a preset or predetermined performance, the power consumption may increase. The operation performance of the air conditioner 100 may vary as operation performance of the outdoor device 110 and the indoor device(s) 160 vary. Also, the more a required indoor load increases, the more the operation performance increases.

The preset or predetermined performance may be understood as a value corresponding to about 100% of rated performance of the air conditioner 100. For example, the rated performance may range from about 80% to about 90% of a maximum performance of the air conditioner 100.

For another example, in a state in which operation of the air conditioner 100 is stopped, a predetermined power (hereinafter, referred to as "standby power") is required to operate a control circuit or display of the air conditioner 100. Electricity used as the standby power may be supplied from the battery 150.

The more an amount of power supplied from the battery 150 increases, the more an amount of power charged in the battery 150 decreases. Thus, the engine may operate at a predetermined time point to generate power through the generator 140 and charge the power into the battery 150.

Hereinafter, a process for charging and discharging a battery while an air conditioner operates, or when operation of an air conditioner is stopped will be described hereinbelow.

Figure 3:
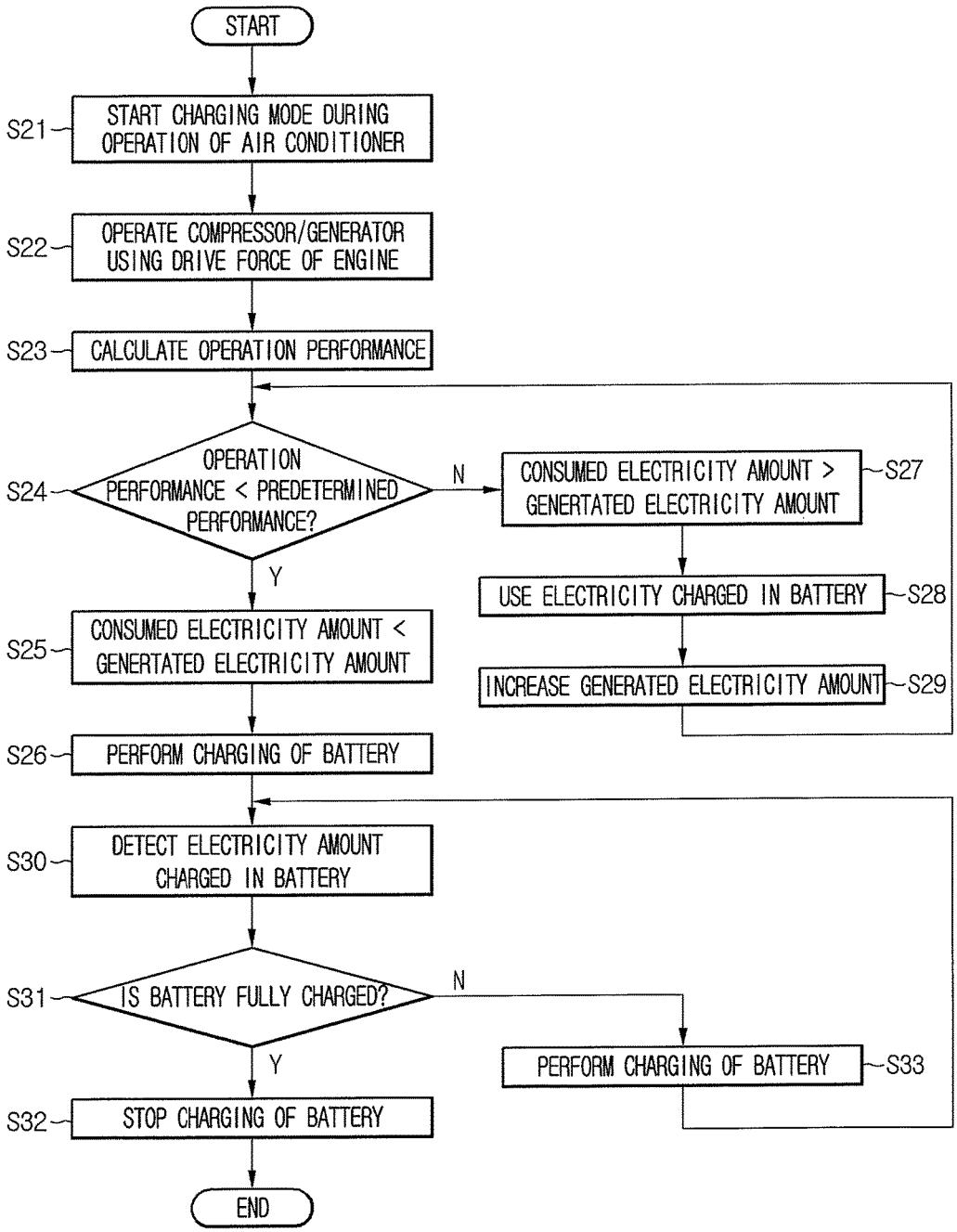
FIG. 3 is a flowchart of a process of charging or discharging a battery while an air conditioner operates according to an embodiment.

FIG. 3 is a flowchart of a process of charging or discharging a battery while an air conditioner operates according to an embodiment. When a "charging mode", in which a battery is charged or discharged, starts during an operation of the air conditioner 100, compressor 130 and generator 140 may operate using a drive force of engine 120, steps S21 and S22.

Then, operation performance of the air conditioner 100 may be calculated, in step S23. For example, in a case in which an amount of refrigerant circulating in a refrigeration cycle increases, for example, in a case in which an operation frequency of the compressor 130 increases, or a number of rotation of an outdoor fan increases, the operation performance of the air conditioner 100 may increase.

Whether or not the operation performance of the air conditioner 100 is less than a preset or predetermined performance may be recognized, in step S24. For example, the preset or predetermined performance may be determined as a performance value that corresponds to about 100% of rated performance of the air conditioner 100.

If the operation performance is less than the preset or predetermined performance C1 (see FIG. 5), it may be recognized that an amount of electricity consumed by the air conditioner 100 is less than an amount of electricity generated by the generator 140, in step S25. Thus, a portion of the power generated by the generator 140 may be used to operate power components of the air conditioner 100, and the rest of the power may be used for charging the battery 150, in step S26.

On the other hand, if the operation performance is greater than the preset or predetermined performance C1, it may be recognized that an amount of electricity consumed by the air conditioner 100 is greater than an amount of electricity generated by the generator 140, in step S27. Thus, if only the power generated by the generator 140 is used, operations of the power components of the air conditioner 100 may be limited. Thus, the electricity charged in the battery 150 may be used, in step S28.

Also, the engine 120 may increase in output to increase an amount of electricity generated by the generator 140, in step S29. If an amount of electricity generated by the generator 140 increases, an amount of electricity supplied to the power components of the air conditioner 100 or an amount of electricity charged to the battery 150 may increase.

That is, as the amount of electricity generated by the generator 140 increases to increase the amount of electricity charged into the battery 150, even though the electricity charged in the battery 150 is used, it may prevent the battery 150 from being quickly discharged. Also, if the amount of electricity generated by the generator 140 increases, the preset or predetermined performance C1 may increase (see FIG. 5). The process returns to step S24 to determine whether the operation performance is less than the preset or predetermined performance.

Figure 5:
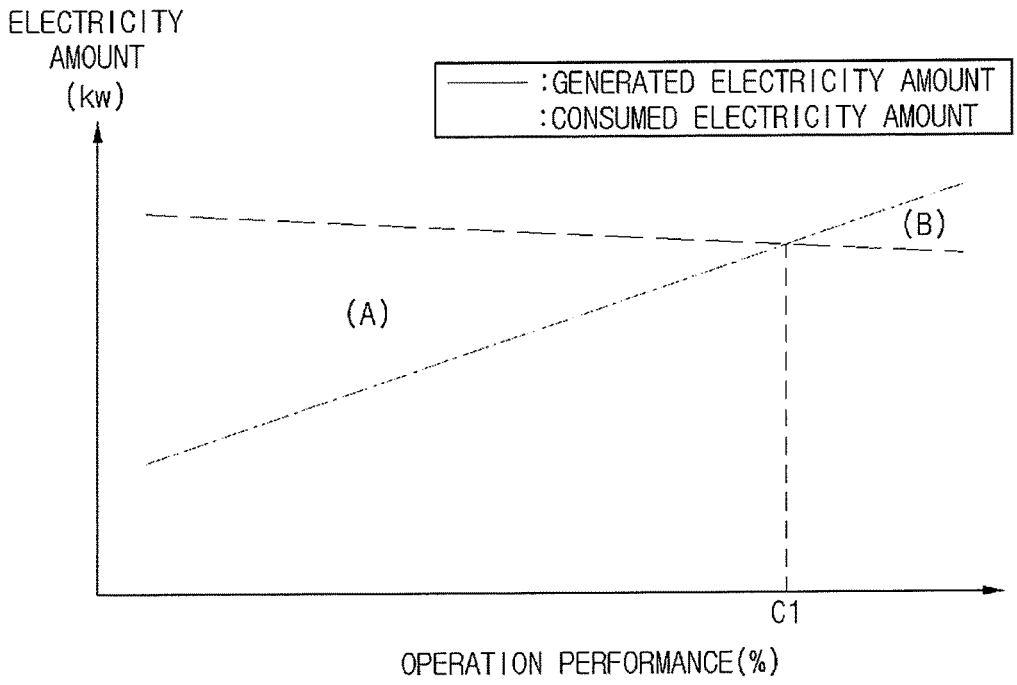
FIG. 5 is a graph illustrating the charging or discharging of the battery depending on operation performance (operation load) of the air conditioner according to an embodiment.

If the amount of electricity generated by the generator 140 increases in FIG. 5, a line that represents an amount of electricity parallelly moves upward. Thus, it may be understood that a cross point of the line representing the amount of electricity and a line representing an amount of consumed electricity moves in a right direction to increase the preset or predetermined performance C1. Thus, an amount of consumable electricity in the air conditioner 100 may increase.

As described above, the charging or discharging of the battery 150 may be performed according to the operation performance of the air conditioner 100. In this process, a charged amount of battery 150 may be continuously detected. An amount or degree of electricity charged into the battery 150 may be determined from a voltage detected from the battery 150, in step S30.

When it is detected that the battery 150 is fully charged, in step S31, the charging of the battery 150 may be stopped, in step S32. That is, all of the electricity generated by the generator 140 may be supplied to the air conditioner 100. Also, the output of the engine 120 may be reduced to correspond to an amount of electricity required for the generator 140. On the other hand, if the battery 150 is not fully charged, the charging of the battery 150 may be continuously performed, in step S33.

Figure 4:
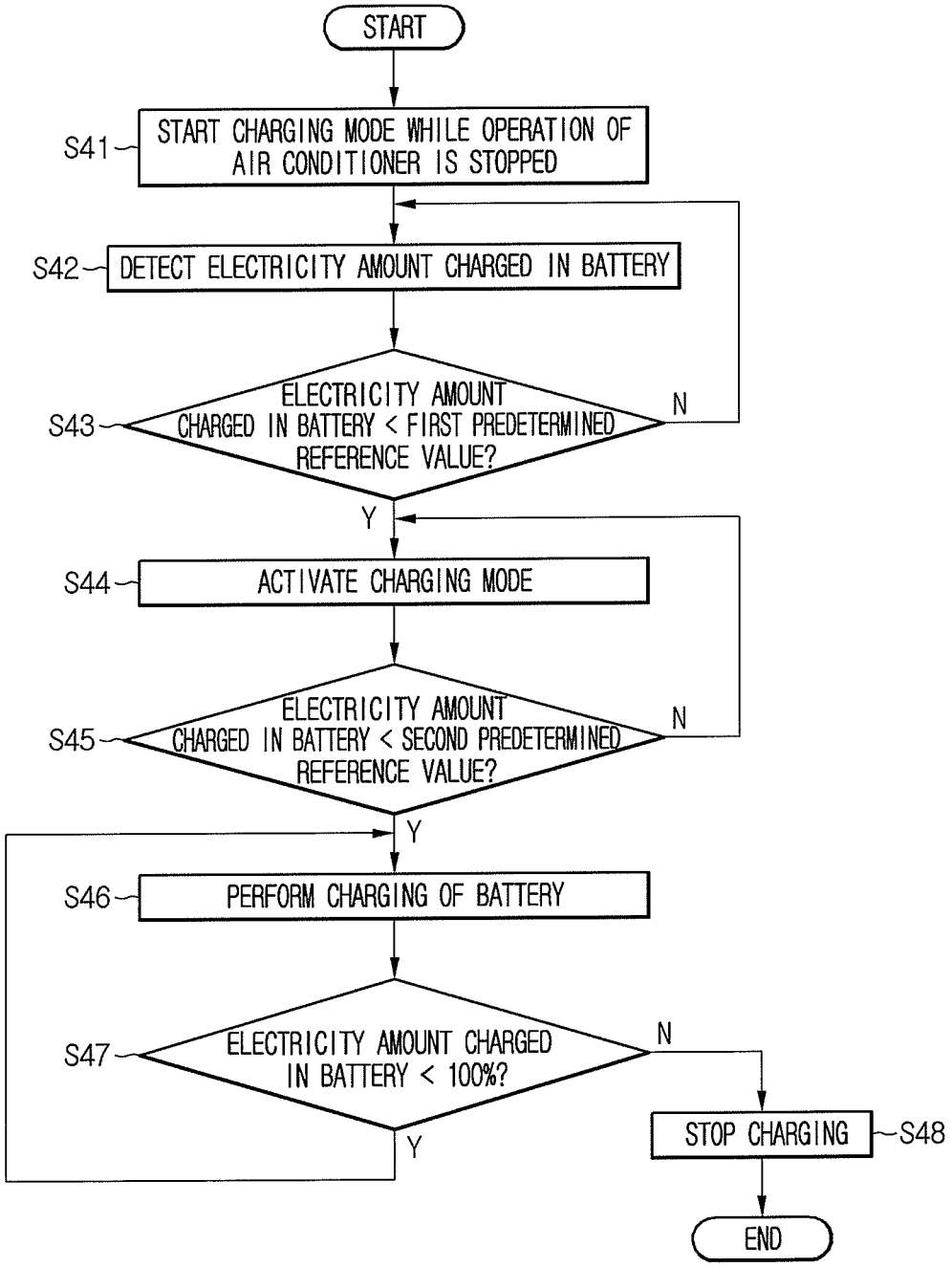
FIG. 4 is a flowchart of a process of charging or discharging the battery in a state in which operation of the air conditioner is stopped according to an embodiment.

FIG. 4 is a flowchart of a process of charging or discharging the battery in a state in which the operation of the air conditioner is stopped according to an embodiment. The operation of the air conditioner 100 described in FIG. 3 may be performed and then stopped according to a preset or predetermined condition(s).

When an operation of the air conditioner 100 is stopped, a "charging mode", in which a battery 150 is charged or discharged, may start. Even though the air conditioner 100 does not operate, a standby power for operating a control circuit or a display may be required. The standby power may be supplied from the battery 150.

As the electricity charged in the battery 150 is used, the charging of the battery 150 may be performed according to a preset or predetermined condition(s), in step S41. In detail, in a state in which the operation of the air conditioner 100 is stopped, a charged amount of battery 150 may be detected, in step S42. If the detected charged amount of battery 150 is less than a first preset or predetermined reference value, in step S43, the charging mode may be activated, in step S44. For example, the first preset or predetermined reference value may range from about 20% to about 40% of an amount of electricity capable of being maximally charged into the battery 150, in step S43.

The activation of the charging mode may be understood as a state in which the charging should start just when the charged amount of battery 150 is less than the preset or predetermined value. When the charging mode is activated, information for informing a state in which the charging of the battery 150 is needed may be displayed on the air conditioner 100. For example, case 112 of outdoor device 110 or indoor device(s) 160 may include a display to display a changed amount information of the battery 150. A user may perform preparation for charging of the battery 150 on the basis of the charged amount information of the battery 150 displayed on the display part.

Also, an operation for preheating the engine 120 may be performed. For example, a valve unit or valve for a gas to be supplied into the engine 120 may be opened by a predetermined opened degree to mix the gas with air. A coolant pump may be converted into an operation standby state.

While the supply of the electricity into the battery 150 is continuously performed for the standby power, and the charged amount is detected, it may be recognized whether the charged amount of battery 150 is less than a second preset or predetermined reference value, in step S45. For example, the second preset or predetermined reference value may be less than the first preset or predetermined reference value and may range from about 5% to about 20% of an amount of electricity capable of being maximally charged into the battery 150.

If the charged amount of battery 150 is less than the second preset or predetermined reference value, the charging of the battery 150 may be performed, in step S46. The charging of the battery 150 may be performed until the charged amount of battery 150 reaches about the maximally charged amount (about 100%), and when the charged amount of battery 150 reaches the maximally charged amount (about 100%), the charging may be stopped, in steps S47 and S48.

FIG. 5 is a graph illustrating the charging or discharging of the battery depending on operation performance (operation load) of the air conditioner according to an embodiment. Referring to FIG. 5, as an operation performance, that is, an operation load of the air condition 100 increases, an amount of electricity consumed by the air conditioner 100 may increase.

Also, an amount of electricity generated by the generator 140 while the engine 120 operates may be maintained to a nearly uniform level or gently decrease as the operation performance of the air conditioner 100 increases. As the operation performance of the air conditioner 100 increases, an amount of electricity required for operating the air conditioner 100 and a load of the compressor 130 may increase. Thus, an amount of electricity generated by the generator 140 may gently decrease.

When the air conditioner 100 has operation performance C1, a line representing the consumed electricity amount of the air conditioner 100 and a line representing the generated electricity amount may meet each other. The operation performance C1 may be referred to as "equilibrium performance" or "set performance" because the generated electricity amount and the consumed electricity amount are the same.

The equilibrium performance C1 may range from about 90% to about 130% of a rated performance of the air conditioner 100, that is, a sum of the rated performance of the indoor device(s) and the rated performance of the outdoor device. For example, the equilibrium performance C1 may range from about 100% of the rated performance of the air conditioner 100.

When the operation performance of the air conditioner 100 is less than the operation performance C1, as the generated electricity amount is greater than the consumed electricity amount of the air conditioner 100, the remaining electricity amount may be charged into the battery 150 (A). The more the operation performance of the air conditioner 100 decreases, the more the amount of electricity charged into the battery 150 may increase.

On the other hand, when the operation performance of the air conditioner 100 is greater than the operation performance C1, as the generated electricity amount is less than the consumed electricity amount of the air condition 150, the charging of the battery may be limited. Thus, the electricity charged in the battery 150 may be used (discharged) (B).

As described above, as the air conditioner according to this embodiment may include the battery, which may be selectively charged or discharged according to operation performance of the air conditioner, electricity use efficiency may be improved to stably operate the air conditioner.

According to this embodiment, the engine provided in the outdoor device may operate to operate the compressor and the generator, and the electricity generated by the generator may be used to supply components of the outdoor device and the indoor device(s). In addition, the remaining electricity may be stored in the battery to improve electricity use efficiency.

Also, the generated electricity amount and the consumed electricity amount may be compared to each other according to the operation performance of the air conditioner. Thus, if the generated electricity amount is relatively large, charging of the battery may be performed. On the other hand, if the consumed electricity amount is relatively large, electricity charged in the battery may be used. Thus, operation efficiency of the air conditioner may be improved.

Also, when the consumed electricity amount is greater than the generated electricity amount while the air conditioner operates, output of the engine may increase to increase the amounts of electricity to be generated by the generator and charged into the battery. Thus, even though the electricity charged into the battery is used, quick consumption of the electricity charged into the battery may be prevented.

Also, in a state in which operation of the air conditioner is stopped, consumption of the electricity charged into the battery by the standby power of the air conditioner may be monitored. Thus, as the charging mode is performed on the basis of the monitored information with respect to the charged electricity amount, the amount of electricity charged into the battery may be maintained to or at a predetermined level or more.

Embodiments disclosed herein provide an air conditioner in which a battery may be charged or discharged, and a method for controlling an air conditioner.

Embodiments disclosed herein provide an air conditioner that may include at least one indoor unit or device; an outdoor unit or device connected to the at least one indoor unit, the outdoor unit including a compressor that compresses a refrigerant; an engine that generates power using a combustion gas to operate the compressor; a generator that generates electricity using the power generated in the engine; a battery that receives at least a portion of the electricity generated in the generator; a first supply line that supplies the electricity stored in the battery into the outdoor unit; and a second supply line that supplies the electricity stored in the battery into the at least one indoor unit. The battery may be charged by the generator, or the electricity stored in the battery may be discharged into the at least one indoor unit or the outdoor unit according to an operation performance of each of the at least one indoor unit and the outdoor unit.

When the operation performance of each of the at least one indoor unit and the outdoor unit is equal to a preset or predetermined performance (C1), an amount of electricity generated in the generator and an amount of electricity consumed in the at least one indoor unit and the outdoor unit may be the same. When the operation performance of each of the at least one indoor unit and the outdoor unit is less than the preset performance (C1), the battery may be charged by the generator.

When the operation performance of each of the at least one indoor unit and the outdoor unit is greater than the preset performance (C1), the electricity stored in the battery may be discharged into the at least one indoor unit or the outdoor unit. When the amount of electricity generated in the generator increases, the preset performance (C1) increases to increase an amount of electricity consumable in the at least one indoor unit and the outdoor unit.

The air conditioner may further include a power transmission part or transmission that transmits the power generated in the engine into the generator. The power transmission part may include an engine pulley; a generator pulley; and a belt that connects the engine pulley to the generator pulley.

The air conditioner may further include an outdoor unit fan provided in the outdoor unit to receive the electricity generated in the generator; a coolant pump that receives the electricity generated in the generator to supply coolant to cool the engine; and an indoor unit fan provided in the indoor unit to receive the electricity generated in the generator.

The preset performance (C1) may range from about 90% to about 130% of sum of a rated performance of the at least one indoor unit and a rated performance of the outdoor unit.

Embodiments disclosed herein further provide a method for controlling an air conditioner that may include operating an engine to operate a compressor provided in the air conditioner, thereby operating a generator; and determining charging or discharging of a battery according to whether operation performance of the air conditioner is greater than a preset or predetermined performance. When the operation performance of the air conditioner is less than the preset performance, electricity generated in the generator may be charged into or to the battery, and when the operation performance of the air conditioner is greater than the preset performance, the electricity stored in the battery may be discharged into the air conditioner.

The method may further include detecting an amount of electricity charged into the battery, and stopping the charging of the battery when it is determined that the battery is fully charged. The method may further include detecting an amount of electricity charged into the battery in a state in which an operation of the air conditioner is stopped, and activating a charging mode when the amount of electricity charged into the battery is less than a first preset or predetermined reference value.

When the charging mode is activated, information with respect to the amount of electricity charged into the battery may be displayed on the air conditioner. Further, when the charging mode is activated, an operation for preheating the engine may be performed.

The method may further include performing the charging of the battery when the amount of electricity charged into the battery is less than a second preset or predetermined reference value, which may be less than the first preset reference value, while the amount of electricity charged into the battery is detected.

The first preset or predetermined reference value may range from about 20% to about 40% of an amount of electricity capable of being maximally charged into the battery. The second preset reference value may range from about 5% to about 20% of the amount of electricity capable of being maximally charged into the battery.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling an air conditioner, the air conditioner comprising at least one indoor device, an outdoor device connected to the at least one indoor device and comprising a compressor that compresses a refrigerant, an engine that generates power using a combustion gas to operate the compressor, a generator that generates electricity using the power generated in the engine, and a battery that receives at least a portion of the electricity generated in the generator, the method comprising:

controlling the air conditioner in a first mode to charge or discharge the battery while the air conditioner is operating, and controlling the air conditioner in a second mode to charge the battery while operation of the air conditioner is stopped, wherein, in the second mode, the air conditioner:

detects an amount of electricity charged into the battery in a state in which the operation of the air conditioner is stopped;

compares the amount of electricity charged into the battery with a first predetermined reference value; and activates a charging mode when the amount of electricity charged into the battery is less than the first predetermined reference value, or continues the detecting when the amount of electricity charged into the battery is not less than the first predetermined reference value, wherein, when the charging mode is activated, an operation for preheating the engine is performed.

2. The method according to claim 1, wherein, in the first mode, the air conditioner:

calculates an operation performance of the air conditioner;

charges the battery by the generator, or discharges electricity stored in the battery to the at least one indoor device or the outdoor device according to the calculated operation performance of the air conditioner, wherein, when the operation performance of each of the at least one indoor device and the outdoor device is less than a predetermined performance, the battery is charged by the generator.

3. The method according to claim 2, wherein, in the first mode, the air conditioner continuously detects a charged amount of electricity in the battery, and stops charging the battery when the charged amount of electricity reaches a maximally charged amount.

4. The method according to claim 2, wherein, when the operation performance of each of the at least one indoor device and the outdoor device is greater than the predetermined performance, the electricity stored in the battery is discharged to the at least one indoor device or the outdoor device.

5. The method according to claim 4, wherein the predetermined performance ranges from about 90% to about 130% of a sum of a rated performance of the at least one indoor device and a rated performance of the outdoor device.

6. The method of claim 1, wherein, in the second mode, the air conditioner further:

compares the amount of electricity charged into the battery with a second predetermined reference value, wherein the second predetermined reference value is lower than the first predetermined reference value; and performs charging of the battery when the amount of electricity charged into the battery is less than the second predetermined reference value, or continues with the activating when the amount of electricity charged into the battery is not less than the second predetermined reference value.

7. The method according to claim 6, wherein the first predetermined reference value ranges from about 20% to about 40% of an amount of electricity capable of being maximally charged into the battery, and wherein the second predetermined reference value ranges from about 5% to about 20% of the amount of electricity capable of being maximally charged into the battery.

8. The method according to claim 6, wherein, in the second mode, the air conditioner stops charging the battery when the charged amount of electricity reaches a maximally charged amount.

9. The method according to claim 1, wherein, when the charging mode is activated, information with respect to the amount of electricity charged into the battery is displayed on the air conditioner.

10. The method according to claim 1, further comprising opening a valve to supply the combustion gas into the engine by a predetermined opened degree to mix the combustion gas with air.

11. The method of claim 10, further comprising setting a coolant pump into an operation standby state.

12. A method for controlling an air conditioner, the air conditioner comprising at least one indoor device, an outdoor device connected to the at least one indoor device and comprising a compressor that compresses a refrigerant, an engine that generates power using a combustion gas to operate the compressor, a generator that generates electricity using the power generated in the engine, and a battery that receives at least a portion of the electricity generated in the generator, the method comprising:

controlling the air conditioner in a first mode to charge or discharge the battery while the air conditioner is operating, and controlling the air conditioner in a second mode to charge the battery while operation of the air conditioner is stopped, wherein, in the second mode, the air conditioner:

detects an amount of electricity charged into the battery in a state in which the operation of the air conditioner is stopped;

compares the amount of electricity charged into the battery with a first predetermined reference value;

activates a charging mode when the amount of electricity charged into the battery is less than the first predetermined reference value, or continues the detecting when the amount of electricity charged into the battery is not less than the first predetermined reference value, wherein, when the charging mode is activated, information with respect to the amount of electricity charged into the battery is displayed on the air conditioner.

13. The method according to claim 12, wherein, in the first mode, the air conditioner:

calculates an operation performance of the air conditioner;

charges the battery by the generator, or discharges electricity stored in the battery to the at least one indoor device or the outdoor device according to the calculated operation performance of the air conditioner, wherein, when the operation performance of each of the at least one indoor device and the outdoor device is less than a predetermined performance, the battery is charged by the generator.

14. A method for controlling an air conditioner, the air conditioner comprising at least one indoor device, an outdoor device connected to the at least one indoor device and comprising a compressor that compresses a refrigerant, an engine that generates power using a combustion gas to operate the compressor, a generator that generates electricity using the power generated in the engine, and a battery that receives at least a portion of the electricity generated in the generator, the method comprising:

controlling the air conditioner in a first mode to charge or discharge the battery while the air conditioner is operating, and controlling the air conditioner in a second mode to charge the battery while operation of the air conditioner is stopped, wherein, in the second mode, the air conditioner:

detects an amount of electricity charged into the battery in a state in which the operation of the air conditioner is stopped;

compares the amount of electricity charged into the battery with a first predetermined reference value;

activates a charging mode when the amount of electricity charged into the battery is less than the first predetermined reference value, or continues the detecting when the amount of electricity charged into the battery is not less than the first predetermined reference value;

compares the amount of electricity charged into the battery with a second predetermined reference value, wherein the second predetermined reference value is lower than the first predetermined reference value, wherein the first predetermined reference value ranges from about 20% to about 40% of an amount of electricity capable of being maximally charged into the battery, and wherein the second predetermined reference value ranges from about 5% to about 20% of the amount of electricity capable of being maximally charged into the battery.

* * * * *